US009410489B2

(12) United States Patent
Miyazono

(10) Patent No.: US 9,410,489 B2
(45) Date of Patent: Aug. 9, 2016

(54) INTERNAL COMBUSTION ENGINE

(75) Inventor: Yuya Miyazono, Susono (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 38 days.

(21) Appl. No.: 14/413,275

(22) PCT Filed: Jul. 9, 2012

(86) PCT No.: PCT/JP2012/067497
§ 371 (c)(1),
(2), (4) Date: Jan. 7, 2015

(87) PCT Pub. No.: WO2014/010018
PCT Pub. Date: Jan. 16, 2014

(65) Prior Publication Data
US 2015/0176506 A1 Jun. 25, 2015

(51) Int. Cl.

| | |
|---|---|
| ***F02D 15/04*** | (2006.01) |
| ***F02D 15/02*** | (2006.01) |
| ***F02B 75/04*** | (2006.01) |
| ***F02F 1/26*** | (2006.01) |

(52) U.S. Cl.
CPC ..... *F02D 15/02* (2013.01); *F02B 75/041* (2013.01); *F02D 15/04* (2013.01); *F02F 1/26* (2013.01)

(58) Field of Classification Search
CPC ..... F02D 15/04; F02B 75/04; F02B 75/041
USPC ..... 123/48 R, 78 R
See application file for complete search history.

(56) References Cited

U.S. PATENT DOCUMENTS

| | | | | |
|---|---|---|---|---|
| 2,686,505 | A | 7/1949 | McCuen | |
| 4,174,683 | A * | 11/1979 | Vivian | F01L 1/352 123/346 |
| 4,359,976 | A * | 11/1982 | Steele | F02F 3/12 123/193.6 |
| 5,003,936 | A | 4/1991 | Scherer | |
| 6,145,488 | A * | 11/2000 | Plechner | F02B 25/14 123/193.1 |
| 7,159,544 | B1 * | 1/2007 | Studdert | F02B 75/30 123/48 B |

(Continued)

FOREIGN PATENT DOCUMENTS

| | | | |
|---|---|---|---|
| CN | 201110224 | Y | 9/2008 |
| DE | 2404231 | A1 | 7/1975 |
| DE | 4211589 | A1 | 10/1993 |
| JP | S57-132048 | U | 8/1982 |

(Continued)

OTHER PUBLICATIONS

International Preliminary Report on Patentability and English translation of the Written Opinion of PCT Application No. PCT/JP2012/067497, (IPRP dated Jan. 13, 2015 / Written Opinion dated Oct. 9, 2012).

*Primary Examiner* — Thomas Moulis
(74) *Attorney, Agent, or Firm* — Kenyon & Kenyon LLP

(57) ABSTRACT

An internal combustion engine equipped with: a cylinder block in the interior of which pistons are arranged; a cylinder head containing recessed parts; cylinder liners affixed to the surfaces of hole parts of the cylinder block; and a variable compression ratio mechanism that changes the mechanical compression ratio. The variable compression ratio mechanism is formed such that the size of the combustion chamber can be changed by moving the cylinder head relative to the cylinder block. The cylinder liners extend such that the end parts facing the cylinder head are arranged within the recessed parts of the cylinder head within the range of relative movement of the cylinder head with respect to the cylinder block.

5 Claims, 7 Drawing Sheets

(56) References Cited

U.S. PATENT DOCUMENTS

| | | | | |
|---|---|---|---|---|
| 7,171,935 | B2 * | 2/2007 | Komai | B22D 19/0009 123/193.2 |
| 7,438,037 | B2 * | 10/2008 | Oogake | F02F 1/004 123/193.2 |
| 7,721,688 | B2 * | 5/2010 | Kamiyama | F02B 75/041 123/41.84 |
| 2004/0211374 | A1 | 10/2004 | Kamiyama | |
| 2009/0266338 | A1 | 10/2009 | Kamiyama et al. | |
| 2012/0145128 | A1 | 6/2012 | Tateno | |

FOREIGN PATENT DOCUMENTS

| | | | |
|---|---|---|---|
| JP | S60-22030 | A | 2/1985 |
| JP | 2008-045443 | A | 2/2008 |
| JP | 2008-075602 | A | 4/2008 |
| JP | 2010-106710 | A | 5/2010 |
| JP | 2010-249107 | A | 11/2010 |
| JP | 2011-144789 | A | 7/2011 |
| JP | 2011-153597 | A | 8/2011 |
| WO | 00/09874 | A1 | 2/2000 |
| WO | 2011/027478 | A1 | 3/2011 |

* cited by examiner

INTERNAL COMBUSTION ENGINE

CROSS-REFERENCE TO RELATED APPLICATION

This is a national phase application based on the PCT International Patent Application No. PCT/JP2012/067497 filed Jul. 9, 2012, the entire contents of which are incorporated herein by reference.

TECHNICAL FIELD

The present invention relates to an internal combustion engine.

BACKGROUND ART

In a combustion chamber of an internal combustion engine, an air-fuel mixture of air and fuel is ignited in a compressed state. It is known that a compression ratio when compressing the air-fuel mixture has an effect on output torque and an amount of fuel consumption. It is possible to raise the compression ratio so as to increase the torque or so as to reduce the amount of fuel consumption. On the other hand, it is known that if making the compression ratio too high, knocking or other abnormal combustion phenomena will occur. In the prior art, there has therefore been known an internal combustion engine which is provided with a various compression ratio mechanism which enables the compression ratio to be changed during the operating period.

Japanese Patent Publication No. 2008-075602A discloses a variable compression ratio mechanism which can change relative positions of a crankcase and a cylinder block in a cylinder axial direction so as to change the volumes of combustion chambers when pistons are positioned at compression top dead center.

Further, Japanese Patent Publication No. 60-22030A discloses a variable compression ratio engine in which a cylinder block is joined to a crankcase or cylinder head by a shape memory alloy. It discloses that this shape memory alloy is formed so as to contract in a cylinder axial direction at a low temperature side and to expand at a high temperature side.

Japanese Patent Publication No. 2008-045443A discloses an internal combustion engine which is provided with a variable compression ratio mechanism which makes a cylinder block move relative to a crankcase wherein the cylinder block and the crankcase have a spring mechanism provided between them. This spring mechanism biases the cylinder block and the crankcase in a direction making them approach each other.

Japanese Patent Publication No. 2011-153597A discloses an internal combustion engine which is provided with a variable compression ratio mechanism which makes a cylinder block move relative to a crankcase wherein a water jacket is formed which runs cooling water to the inside of a cylinder head.

Japanese Patent Publication No. 2011-144789A discloses an internal combustion engine which is provided with a variable compression ratio mechanism which makes a cylinder block move relative to a crankcase wherein the cylinder block and the crankcase have a ring-shaped seal member provided between them. This discloses that the seal member is formed so as to cover the clearance between the cylinder block and the crankcase over the entire circumference of the internal combustion engine.

Further, Japanese Patent Publication No. 2010-106710A discloses a cylinder liner which is provided in a cylinder block and which slides with a piston. This cylinder liner has a sliding surface part which allows the piston to slide and a nonsliding surface part which does not contact the piston. This discloses that the sliding surface part is comprised of an inner wall surface of a cylindrical member, while the nonsliding surface part is comprised of the end part of the cylindrical member which is gradually increased in diameter from the inner wall surface outward in the radial direction to form an inclined surface.

CITATIONS LIST

Patent Literature

PLT 1. Japanese Patent Publication No. 2008-075602A
PLT 2. Japanese Patent Publication No. 60-22030A
PLT 3. Japanese Patent Publication No. 2008-045443A
PLT 4. Japanese Patent Publication No. 2011-153597A
PLT 5. Japanese Patent Publication No. 2011-144789A
PLT 6. Japanese Patent Publication No. 2010-106710A

SUMMARY OF INVENTION

Technical Problem

As disclosed in the above-mentioned Japanese Patent Publication No. 2008-075602A and Japanese Patent Publication No. 2008-045443A, it is possible to make a cylinder block move relative to a crankcase so as to change a mechanical compression ratio. In this case, the crankcase becomes the non-moving part, while the cylinder block and the cylinder head which is fastened to the cylinder block become the moving parts. In such an internal combustion engine, there was the problem that vibration occurred due to movement of the moving parts during the operating period.

For example, in an inline-four internal combustion engine, the plurality of cylinders from the #1 cylinder to the #4 cylinder are arranged in a single line. If combustion occurs in the #1 cylinder, a combustion load is applied to the cylinder head. At this time, due to elastic deformation of the cylinder block, elastic deformation of the crankcase, clearance of the bearings of the variable compression ratio mechanism, etc., the end part of the cylinder block at which the #1 cylinder is arranged rises up. At the end part at the opposite side where the #4 cylinder is arranged, no combustion occurs, so the part descends. After that, if combustion occurs at the #4 cylinder, the end part where the #4 cylinder is arranged rises while the end part where the #1 cylinder is arranged descends. If this phenomenon is repeated, motion called "pitching" where the cylinder head swings with respect to the crankcase will occur along the direction in which the plurality of cylinders are arranged (longitudinal direction). An internal combustion engine sometimes will vibrate due to this pitching motion.

Further, the pistons are connected through connecting rods to a crankshaft, so the cylinder block is subjected to a force in a direction (thrust direction) vertical to the direction in which the pistons move back and forth. The thrust force due to the pistons acts on the cylinder block whereby, due to elastic deformation of the cylinder block, elastic deformation of the crankcase, clearance at the bearings of the variable compression ratio mechanism, etc., the cylinder head sometimes rolls with respect to the crankcase. Motion occurs whereby the cylinder block slants with respect to the crankcase in the width direction. This motion occurs along the direction vertical to the direction in which the plurality of cylinders are arranged and is called "rolling motion." An internal combustion engine will sometime vibrates due to this rolling motion.

Furthermore, the inertia force of the reciprocating motion of the pistons sometimes causes the crankcase to vibrate in the direction of movement of the pistons. Such vibration acts on the cylinder block and sometimes causes a lifting motion where the cylinder block moves in the direction of the reciprocating motion of the piston. To suppress the lifting motion, sometimes the crankcase and the cylinder block have a spring arranged between them. In such a case as well, if the load which is applied from the cylinder block to the spring becomes a predetermined value or more, vibration derived from the lifting motion will sometimes occur.

In this way, in an internal combustion engine which is provided with a variable compression ratio mechanism, there is the problem that vibration occurs due to the above-mentioned motions. Further, if vibration occurs, the cylinder block will move in the up-down direction and the left-right direction with respect to the crankcase, so at the bearings or at the slider etc. which are arranged between the crankcase and the cylinder block, a knocking sound will sometimes be generated.

The present invention has as its object the provision of an internal combustion engine which is provided with a variable compression ratio mechanism which can suppress vibration.

Solution to Problem

The internal combustion engine of the present invention is provided with a cylinder block which has a hole inside of which a piston is arranged, a cylinder head which includes a recess which has a top surface of a combustion chamber, a cylinder liner which is fastened at a surface of the hole of the cylinder block and which the piston contacts, and a variable compression ratio mechanism which changes a mechanical compression ratio. The variable compression ratio mechanism is formed so that the cylinder head is moved relative to the cylinder block whereby the combustion chamber is variably formed in size. The cylinder liner extends so that, in the range where the cylinder head moves relative to the cylinder block, an end part facing the cylinder head is arranged inside of the recess of the cylinder head.

In the above invention, the end part of the cylinder liner can be formed so as to stick out from the cylinder block and can slide with respect to the recess of the cylinder head.

In the above invention, an elastic member can be provided which is arranged between the cylinder block and the cylinder head and biases the cylinder head with respect to the cylinder block, and the elastic member can be arranged around a cylinder liner and can have a shape which surrounds the cylinder liner.

In the above invention, the cylinder liner can be formed so that the end part which faces the cylinder head gradually becomes thinner the further toward a front end.

In the above invention, the cylinder head can have a channel for cooling water which is formed at a side of a region in which the end part of the cylinder liner is inserted into the recess.

In the above invention, preferably a sealing member is provided which is arranged between the cylinder block and the cylinder head, and the sealing member is arranged around the cylinder liner for each cylinder and has a shape which surrounds the cylinder liner.

Advantageous Effects of Invention

According to the present invention, it is possible to suppress vibration in an internal combustion engine which is provided with a variable compression ratio mechanism.

DESCRIPTION OF EMBODIMENTS

Referring to FIG. 1 to FIG. 11, an internal combustion engine in the embodiment will be explained. In the present embodiment, an internal combustion engine which is arranged in a vehicle will be taken up as an example.

Figure 1:
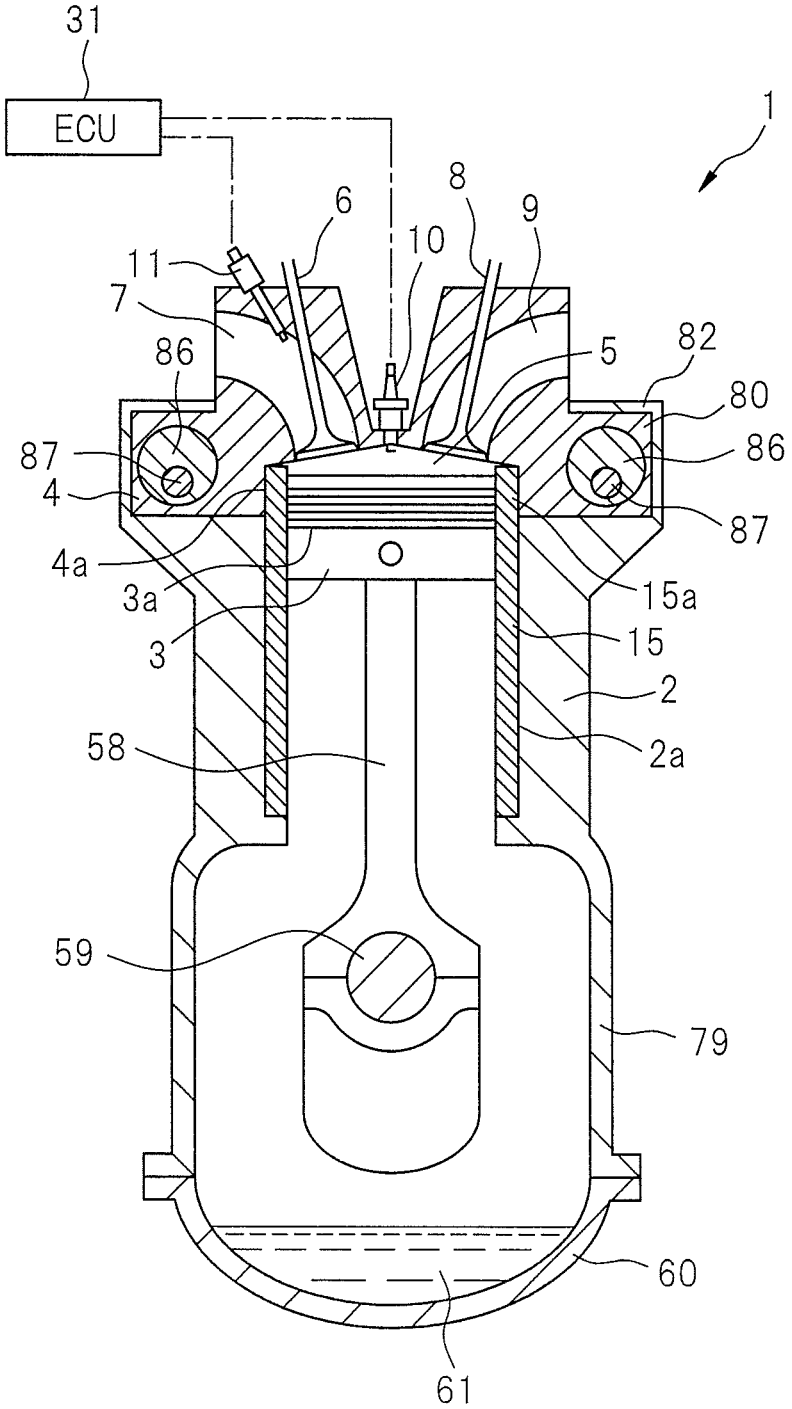
FIG. 1 is a schematic view of a first internal combustion engine in an embodiment.

FIG. 1 is a schematic view of an internal combustion engine in the present embodiment. The internal combustion engine in the present embodiment is a spark ignition type. The internal combustion engine is provided with an engine body 1. The engine body 1 includes a cylinder block 2 and a cylinder head 4. Inside of the cylinder block 2, pistons 3 are arranged.

A combustion chamber 5 is formed for each cylinder. At the combustion chamber 5, an engine intake passage and engine exhaust passage are connected. At the cylinder head 4, an intake port 7 and exhaust port 9 are formed. An intake valve 6 is arranged at an end part of the intake port 7 and is formed to be able to open and close the engine intake passage which communicates with the combustion chamber 5. An exhaust valve 8 is arranged at an end part of the exhaust port 9 and is formed to be able to open and close the engine exhaust passage which communicates with the combustion chamber 5. At the cylinder head 4, an ignition device constituted by a spark plug 10 is fastened. The spark plug 10 is formed so as to ignite the fuel at the combustion chamber 5.

The internal combustion engine in the present embodiment is provided with a fuel injector 11 for feeding fuel to each combustion chamber 5. The fuel injector 11 in the present embodiment is arranged so as to inject fuel to the intake port 7. The fuel injector 11 is not limited to this and may also be arranged so as to feed fuel to the combustion chamber 5. For example, the fuel injector may also be arranged so as to directly inject fuel to the combustion chamber.

The cylinder block 2 has holes 2*a*. At the surfaces of the holes 2*a*, cylinder liners 15 are fastened. The cylinder liners 15 in the present embodiment are formed into cylindrical shapes. The pistons 3 contact the cylinder liners 15. Further, the pistons 3 slide with respect to the cylinder liners 15. The pistons 3 are supported by a crankshaft 59 through connecting rods 58. The pistons 3 engage in reciprocating motion between top dead center and bottom dead center. Due to the reciprocating motion of the pistons 3, the crankshaft 59 rotates.

The internal combustion engine in the present embodiment is provided with a supporting structure which supports the crankshaft 59. The supporting structure in the present embodiment includes the cylinder block 2. The cylinder block 2 includes a part inside of which the pistons 3 are arranged and also a crankcase part 79 and oil pan part 60. Inside of the crankcase part 79, the crankshaft 59 is arranged. Further, the crankshaft 59 is supported by the crankcase part 79. The oil pan part 60 is fastened to the crankcase part 79. Inside of the oil pan part 60, oil 61 which lubricates the members which are included in the engine body 1 is stored.

The internal combustion engine in the present embodiment is provided with an electronic control unit 31. The electronic control unit 31 in the present embodiment includes a digital computer and functions as a control device. Output signals of various sensors such as an air flow meter which is arranged in the engine intake passage, a crank angle sensor which is arranged around the crankshaft 59, and a temperature sensor which is arranged at a predetermined position are input to the electronic control unit 31.

The electronic control unit 31 is connected through corresponding drive circuits to the fuel injectors 11 and spark plugs 10. The electronic control unit 31 in the present embodiment is formed so as to perform fuel injection control or ignition control. A step motor which drives a throttle valve which is arranged in the engine intake passage, a fuel pump, and other equipment which are contained in the internal combustion engine are controlled by the electronic control unit 31.

The internal combustion engine in the present embodiment is provided with a variable compression ratio mechanism. In the present embodiment, a space which is surrounded by a recess 4*a* of the cylinder head 4 and a crown of a piston 3 when the piston is positioned at compression top dead center will be called a "combustion chamber". The compression ratio of the internal combustion engine is determined by the volumes etc. of the combustion chambers. The variable compression ratio mechanism in the present embodiment is formed to change the volumes of the combustion chambers so as to change the compression ratio. The actually effective compression ratio in the combustion chamber, that is, the "actual compression ratio", is shown as (actual compression ratio)=(volume of combustion chamber+volume when piston moves in period when intake valve is closed)/(volume of combustion chamber).

Figure 2:
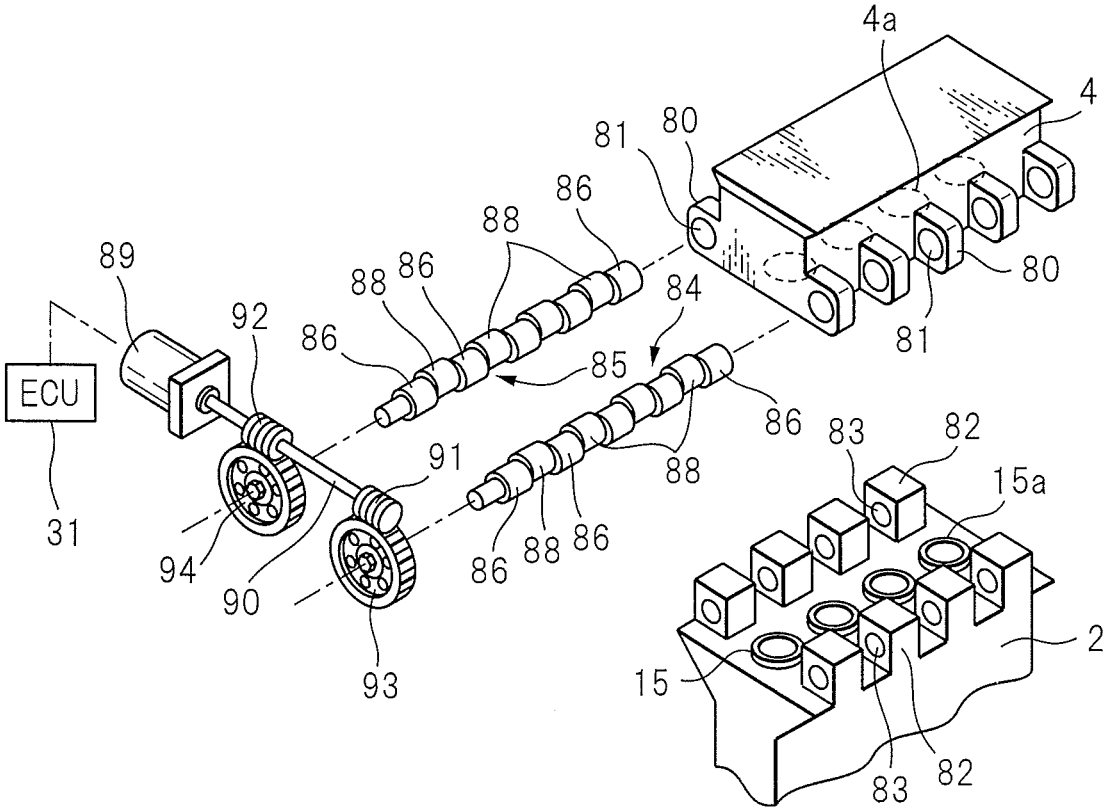
FIG. 2 is a schematic disassembled perspective view of a variable compression ratio mechanism in the embodiment.
Figure 3:
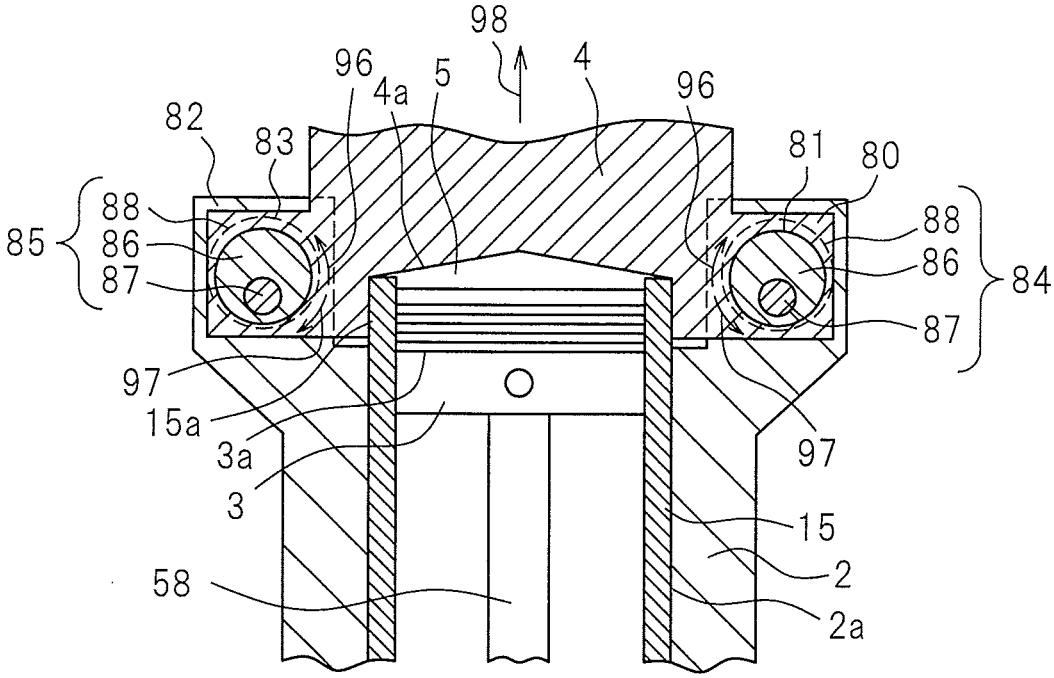
FIG. 3 is a schematic cross-sectional view of a cylinder block and cylinder head at the time where a mechanical compression ratio is a high compression ratio in the first internal combustion engine of the embodiment.

FIG. 2 is a disassembled perspective view of a variable compression ratio mechanism of an internal combustion engine in the present embodiment. FIG. 3 is a first schematic cross-sectional view of a part of a combustion chamber in the internal combustion engine. FIG. 3 is a schematic view when the variable compression ratio mechanism is used to set a high compression ratio. The internal combustion engine in the present embodiment is configured so that a supporting structure which includes the cylinder block 2 and a cylinder head 4 which is arranged at a top side of the supporting structure move relative to each other. The cylinder block 2 in the present embodiment supports the cylinder head 4 through the variable compression ratio mechanism.

Referring to FIG. 2 and FIG. 3, a plurality of projecting parts 80 are formed at the bottoms of the side walls at the both sides of the cylinder head 4. At the projecting parts 80, cam insertion holes 81 with circular cross-sectional shapes are formed. At the top wall of the cylinder block 2, a plurality of projecting parts 82 are formed. At the projecting parts 82, cam insertion holes 83 with circular cross-sectional shapes are formed. The projecting parts 82 of the cylinder block 2 fit between the projecting parts 80 of the cylinder head 4.

The variable compression ratio mechanism in the present embodiment includes a pair of camshafts 84 and 85 serving as support shafts for the cylinder head 4. The camshafts 84 and 85 include circular cams 88 which are rotably inserted inside the respective cam insertion holes 83. The circular cams 88 are arranged coaxially with the axes of rotation of the camshafts 84 and 85. On the other hand, at the both sides of the respective circular cams 88, eccentric shafts 87 which are arranged eccentrically with respect to the axes of rotation of the camshafts 84 and 85 extend. On these eccentric shafts 87, other circular cams 86 are attached eccentrically to be able to rotate. These circular cams 86 are arranged at the both sides of the circular cams 88. The circular cams 86 are inserted to be able to rotate in the corresponding cam insertion holes 81.

The variable compression ratio mechanism includes a motor 89. At a shaft 90 of the motor 89, two worm gears 91 and 92 with spiral directions opposite to each other are attached. At the end parts of the camshafts 84 and 85, worm wheels 93 and 94 are fastened. The worm wheels 93 and 94 are arranged so as to mesh with the worm gears 91 and 92. By the motor 89 turning the shaft 90, the camshafts 84 and 85 can be made to rotate in mutually opposite directions. The motor 89 is connected through a corresponding drive circuit to the electronic control unit 31. The motor 89 is controlled by the electronic control unit 31. That is, the variable compression ratio mechanism in the present embodiment is controlled by the electronic control unit 31.

Referring to FIG. 3, if the circular cams 88 which are arranged on the respective camshafts 84 and 85 are made to rotate in opposite directions to each other such as shown by the arrow marks 97, the eccentric shafts 87 move toward the top ends of the circular cams 88. The circular cams 86 rotate in opposite directions from the circular cams 88 inside the cam insertion holes 81 as shown by the arrow marks 96.

Figure 4:
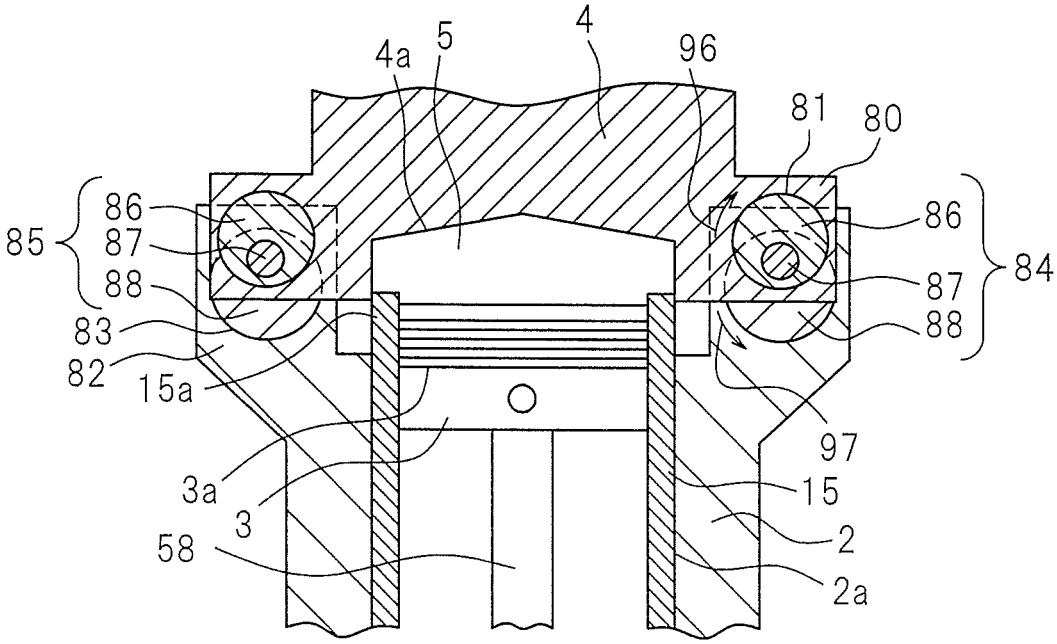
FIG. 4 is a schematic cross-sectional view of a cylinder block and cylinder head at the time where a mechanical compression ratio is a low compression ratio in the first internal combustion engine of the embodiment.

FIG. 4 shows a second schematic cross-sectional view of a part of the combustion chamber in the internal combustion engine of the present embodiment. FIG. 4 is a schematic view of the time when the variable compression ratio mechanism is used to set a low compression ratio. As shown in FIG. 4, if the eccentric shaft 87 moves up to the top end of the circular cam 88, the center axis of the circular cam 88 moves below even more than the eccentric shaft 87. Referring to FIG. 3 and FIG. 4, the relative positions of the cylinder block 2 and cylinder head 4 are determined by the distance between the center axis of the circular cam 86 and the center axis of the circular cam 88. The larger the distance between the center axis of the circular cam 86 and the center axis of the circular cam 88, the further the cylinder head 4 moves in a direction away from the cylinder block 2. As shown by the arrow mark 98, the more the cylinder head 4 moves away from the cylinder block 2, the larger the volume of the combustion chamber 5 when the piston 3 reaches compression top dead center.

In this way, the variable compression ratio mechanism in the present embodiment is configured to make the cylinder head 4 move relative to the cylinder block 2 so as to enable the combustion chambers 5 to be changed in volume. In the present embodiment, the compression ratio which is determined by only the stroke volume of a piston from bottom dead center to top dead center and the volume of a combustion chamber will be referred to as the "mechanical compression ratio". The mechanical compression ratio is shown by (mechanical compression ratio)=(volume of combustion chamber+stroke volume of piston from bottom dead center to top dead center)/(volume of combustion chamber).

In FIG. 3, the piston 3 has reached compression top dead center and the combustion chamber 5 has become small in volume. If the amount of intake air is constant, the compression ratio rises. This state is the state of a high mechanical compression ratio. As opposed to this, in FIG. 4, the piston 3 reaches compression top dead center and the combustion chamber 5 becomes large in volume. If the amount of intake air is constant, the compression ratio falls. This state is the state of a low mechanical compression ratio. In this way, the internal combustion engine in the present embodiment enables the compression ratio to be changed during the operating period. For example, the variable compression ratio mechanism can be used to change the compression ratio in accordance with the operating state of the internal combustion engine.

Note that, the actually effective compression ratio, that is, the "actual compression ratio", can be changed by changing the closing timing of the intake valve in addition to changing the mechanical compression ratio. When the internal combustion engine is provided with a variable valve mechanism which can change the closing timing of the intake valve, the variable valve mechanism and the variable compression ratio mechanism can be operated to change the actual compression ratio.

The variable compression ratio mechanism in the present embodiment is configured to make the circular cams provided eccentrically on the shaft rotate so as to make the cylinder head move relative to the cylinder block, but the invention is not limited to this. It is possible to employ any mechanism which makes the cylinder head move relative to the cylinder block.

Referring to FIG. 1, FIG. 3, and FIG. 4, each cylinder liner 15 in the present embodiment has an end part 15*a* at the side facing the cylinder head 4. The end part 15*a* in the present embodiment is formed so as to stick out from the cylinder block 2. The cylinder head 4 is formed with recesses 4*a* for forming the combustion chambers 5. The recesses 4*a* have top surfaces of the combustion chambers 5. The recesses 4*a* are formed so that end parts 15*a* of the cylinder liners 15 can be inserted into them. In the present embodiment, the end parts 15*a* of the cylinder liners 15 are fit into the recesses 4*a* of the cylinder head 4.

Referring to FIG. 3 and FIG. 4, if changing the mechanical compression ratio, the cylinder head 4 moves relative to the cylinder block 2 in the direction of movement of the pistons 3. In the present embodiment, the end parts 15*a* of the cylinder liners 15 slide relative to the recesses 4*a* of the cylinder head 4. The cylinder liners 15 extend so that the end parts 15*a* are arranged inside of the recesses 4*a* of the cylinder head 4 in the range where the cylinder head 4 can move relative to the cylinder block 2. By the cylinder liners 15 being formed to extend up to the insides of the recesses 4*a* of the cylinder head 4 in this way, even if the cylinder head 4 moves relative to the cylinder block 2, the combustion chambers 5 can be sealed and, furthermore, the combustion chambers 5 can be changed in volume.

As a comparative example, an internal combustion engine which comprises a crankcase and a cylinder block which are formed individually and is provided with a variable compression ratio mechanism which makes the cylinder block move relative to the crankcase will be taken up as an example. In the internal combustion engine of the comparative example, the crankcase becomes the non-moving part, while the cylinder block and cylinder head become the integral moving parts. As opposed to this, in the internal combustion engine of the present embodiment, the cylinder block 2 includes the crankcase part, and the part where the pistons are arranged and the crankcase part can be integrally formed. For this reason, it is possible to raise the rigidity of the non-moving part which includes the cylinder block. It is possible to reduce the pitching motion of pitching in the direction of arrangement of cylinders in the internal combustion engine. As a result, vibration which is due to pitching motion can be reduced.

Further, in the internal combustion engine which is provided with the variable compression ratio mechanism in the comparative art, thrust force in a direction vertical to the direction of movement of the piston is applied to the cylinder block of the moving part, so vibration easily occurs. On the other hand, in the internal combustion engine of the present embodiment, the cylinder block 2 is fastened to the vehicle body and constitutes a non-moving part. The thrust force which occurs due to movement of the pistons 3 acts on the non-moving part constituted by the cylinder block 2. For this reason, rolling motion in a direction vertical to the direction in which the plurality of cylinders are arranged can be suppressed. As a result, the occurrence of vibration derived from rolling motion can be suppressed.

Further, as explained in the later mentioned second internal combustion engine, an elastic member may be arranged at the internal combustion engine to suppress lifting motion. The moving part in this embodiment is light in weight since it does not include the cylinder block and is constituted by the cylinder head. For this reason, the inertia force of the moving part becomes smaller and therefore an elastic member can be used to effectively suppress the lifting motion. As a result, vibration derived from lifting motion can be reduced. Alternatively, the elastic member can be made smaller. In this way, the internal combustion engine of the present embodiment can effectively suppress vibration.

Furthermore, in the internal combustion engine of the present embodiment, head bolts for fastening the cylinder head 4 to the cylinder block 2 become unnecessary. For this reason, deformation of the holes 2*a* of the cylinder block 2 due to fastening of the head bolts can be suppressed. If deformation of the holes 2*a* of the cylinder block 2 is suppressed, when the pistons 3 move, the pressing forces of the piston rings 3*a* can be kept from becoming locally higher. Further, the friction between the piston rings 3*a* and the cylinder liners 15 can be reduced, so the ability of the piston rings 3*a* to track the liners can be improved. As a result, the amount of fuel consumption can be reduced. Further, the amount of the blowby gas which passes between the pistons 3 and cylinder liners 15 and leaks from the combustion chambers 5 to the inside of the crankcase part 79 is reduced. For this reason, the unburned fuel is decreased and the amount of fuel consumption is improved.

Furthermore, if deformation of the holes 2*a* is suppressed, the piston rings 3*a* can effectively scrape off the oil. The oil which remains inside of the combustion chambers 5 can be reduced. As a result, the amount of consumption of oil can be reduced. Furthermore, by the amount of blowby gas being reduced, when blowby gas is returned to the engine intake passage, the oil which is carried to the engine intake passage together with the blowby gas is reduced. For this reason, the amount of consumption of oil can be reduced.

Further, in the internal combustion engine of the present embodiment, deformation of the cylinder block 2 or cylinder head 4 which supports the drive shaft of the variable compression ratio mechanism due to fastening of head bolts is eliminated, so the dimensional precision of the housing which supports the drive shaft can be improved. In the present embodiment, deformation of the cam insertion holes 81 and 83 in which the circular cams 86 and 88 are inserted can be suppressed. Further, in a variable compression ratio mechanism of the comparative art where the cylinder block is made to move relative to the crankcase, a gasket is required between the cylinder block and the cylinder head. As opposed to this, in the internal combustion engine of the present embodiment, it is possible to eliminate the gasket.

Furthermore, in the internal combustion engine of the present embodiment, the part in which the pistons are arranged and the crankcase part which holds the crankshaft inside it can be formed integrally and therefore the productivity can be improved. Further, to lighten the weight of the moving parts, the drive apparatus for driving the variable compression ratio mechanism can be made smaller. For example, referring to FIG. 2, the motor 89 etc. which drives the circular cams 86 and 88 or camshafts 84 and 85 can be made smaller. As a result, the internal combustion engine can be made smaller in size and mounting in a vehicle etc. become easy.

The internal combustion engine in the present embodiment is formed so that the end parts 15*a* of the cylinder liners 15 and the recesses 4*a* of the cylinder head 4 slide with each other, but the invention is not limited to this. Wall parts of the cylinder block body may also be formed around the cylinder liners. That is, the cylinder block body may be formed with engagement parts which stick out toward the cylinder head. The end parts of the cylinder liners may also be arranged at the inside surfaces of the engagement parts. In this case, the engagement parts of the cylinder block and the recesses of the cylinder head can be formed to engage with each other. Further, the engagement parts of the cylinder block can also be formed so as to slide with respect to the recesses of the cylinder head.

Figure 5:
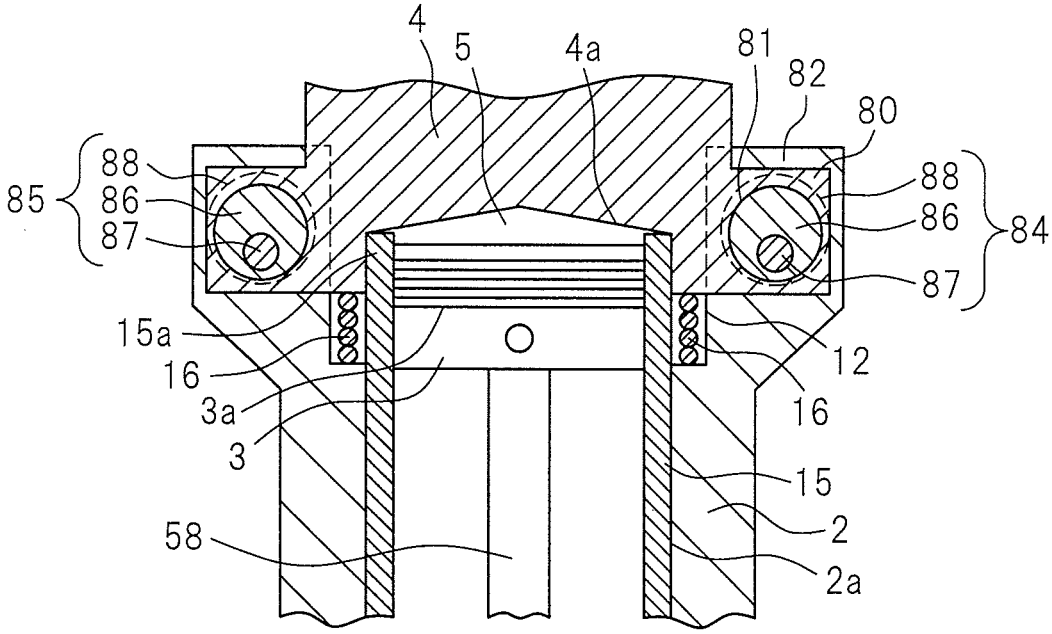
FIG. 5 is an enlarged schematic cross-sectional view of a cylinder block and cylinder head of a second internal combustion engine of the embodiment.

Next, the second internal combustion engine in the present embodiment will be explained. FIG. 5 is a schematic cross-sectional view of the second internal combustion engine in the present embodiment. The second internal combustion engine is provided with an elastic member which is arranged between the cylinder block 2 and the cylinder head 4. As the elastic member of the present embodiment, a coil spring 16 is arranged.

Figure 6:
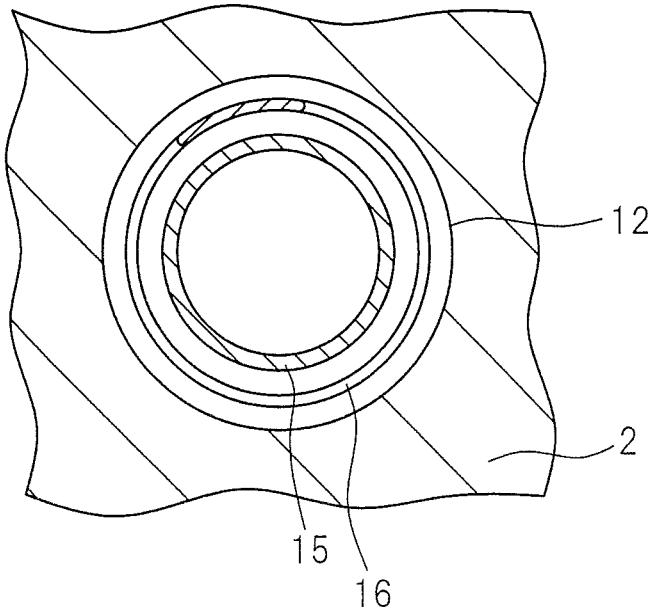
FIG. 6 is a schematic cross-sectional view when cutting along a part where an elastic member is arranged in the second internal combustion engine of the embodiment.

FIG. 6 is a schematic cross-sectional view when cut along the part where the coil spring 16 is arranged in one cylinder. Referring to FIG. 5 and FIG. 6, at the top part of the cylinder block 2, a cutaway part 12 is formed. The cutaway part 12 is formed along the shape of the cylinder liner 15. The cutaway part 12 is formed so as to surround the cylinder liner 15.

The coil spring 16 of the present embodiment is arranged for each cylinder. The coil springs 16 are arranged around the cylinder liners 15. The coil springs 16 have shapes which surround the cylinder liners 15. The coil springs 16 are arranged inside of the cutaway parts 12. The coil springs 16 in the present embodiment bias the cylinder head 4 in a direction making the cylinder head 4 separate from the cylinder block 2.

In the second internal combustion engine of the present embodiment, it is possible to bias the cylinder head 4 in a direction away from the cylinder block 2 during the operating period. For this reason, during the period in which the mechanical compression ratio is not changed, it is possible to suppress lifting motion where the cylinder head 4 moves from the cylinder block 2 in the direction of movement of the pistons. As a result, vibration which is derived from the lifting motion can be suppressed.

In the internal combustion engine of the present embodiment, it is possible to arrange the elastic members so as to surround the cylinder liners 15, so large elastic members can be employed. In the internal combustion engine of the comparative art where the cylinder block moves relative to the crankcase, coil springs are arranged between the cylinder block and the crankcase. The space between the cylinder block and the crankcase is small, so small coil springs are arranged. In this case, the areas of the bearing surfaces where the coil springs are arranged become smaller and the stress at the bearing surfaces becomes higher. For this reason, cracks or other damage was liable to occur at the parts of the bearing surfaces of the crankcase or cylinder block. Furthermore, the coil springs bias the large weight moving parts such as the cylinder block and cylinder head, so the internal stress becomes large and damage easily occurs.

As opposed to this, in the second internal combustion engine of the present embodiment, it is possible to arrange large elastic members, so it is possible to increase the elastic forces of the elastic members and effectively suppress vibration. Further, by the elastic members becoming larger, the areas of the bearing surfaces where the elastic members are arranged become larger. It is possible to reduce the stress at the bearing surfaces. Furthermore, it is possible to reduce the stress which occurs inside the elastic members.

Elastic members can be arranged for all of the cylinders. Alternatively, elastic members can be arranged for part of the cylinders among the plurality of cylinders. For example, in an inline-four internal combustion engine, elastic members may also be arranged at the #1 cylinder and the #4 cylinders and not arranged at the #2 cylinder and #3 cylinder.

In the present embodiment, coil springs are arranged as the elastic members, but the invention is not limited to this. It is possible to employ any elastic members which bias the cylinder head in a direction away from the cylinder block.

Figure 7:
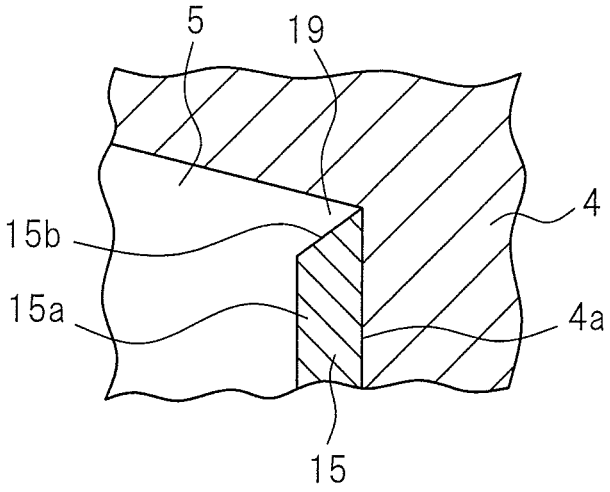
FIG. 7 is an enlarged schematic cross-sectional view of an end part of a cylinder liner of a third internal combustion engine of the embodiment.

Next, a third internal combustion engine in the present embodiment will be explained. FIG. 7 is an enlarged cross-sectional view of an end part of a cylinder liner of the third internal combustion engine in the present embodiment. FIG. 7 shows the state where the mechanical compression ratio is high. The end part 15*a* of the cylinder liner 15 is inserted up to near the top surface of the combustion chamber 5.

In the third internal combustion engine of the present embodiment, the cylinder liner 15 has an end part 15*a* facing the cylinder head 4 and slanted toward the inside of the combustion chamber 5 to give a tapered shape. The end part 15*a* has a pointed shape at its front end and has a shape which becomes gradually thinner toward the front end. The end face 15*b* of the cylinder liner 15 is slanted toward the combustion chamber 5.

Figure 8:
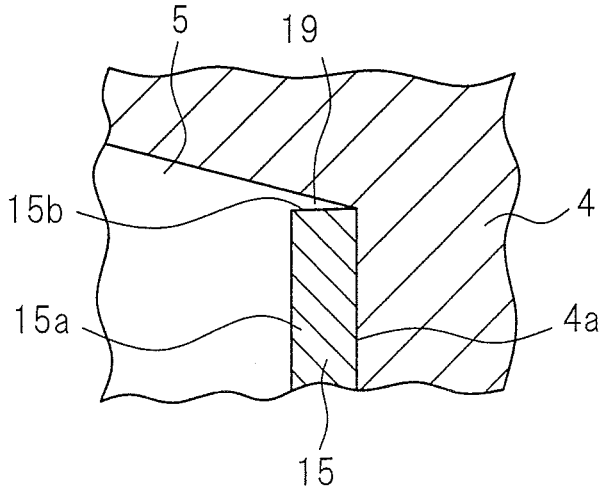
FIG. 8 is an enlarged schematic cross-sectional view of an end part of a cylinder liner of a comparative example.

FIG. 8 shows an enlarged schematic cross-sectional view of an end part of a cylinder liner of a comparative example. The end part 15*a* of the cylinder liner 15 of the comparative example is formed with a substantially constant thickness. The end face 15*b* of the end part 15*a* is formed to become substantially vertical with respect to the direction in which the cylinder liner 15 extends. In the cylinder liner of the comparative example, the space 19 sandwiched between the end face 15*b* and the top surface of the recess 4*a* of the cylinder head 4 becomes narrower. For this reason, at the space 19, the fuel will not burn or misfires will occur and in some cases unburned fuel will be produced.

Referring to FIG. 7, as opposed to this, in the third internal combustion engine of the present embodiment, the end part 15*a* of the cylinder liner 15 is formed in a tapered shape, so the space 19 can be made larger. In particular, at a high mechanical compression ratio where the volume of the combustion chamber 5 becomes smaller, it is possible to avoid the space 19 becoming narrower. For this reason, production of unburned fuel at the space 19 can be suppressed and the amount of fuel consumption can be improved. Further, variation of the combustion at the inside of the combustion chamber 5 can be suppressed. For this reason, vibration of the internal combustion engine can be more effectively suppressed.

Figure 9:
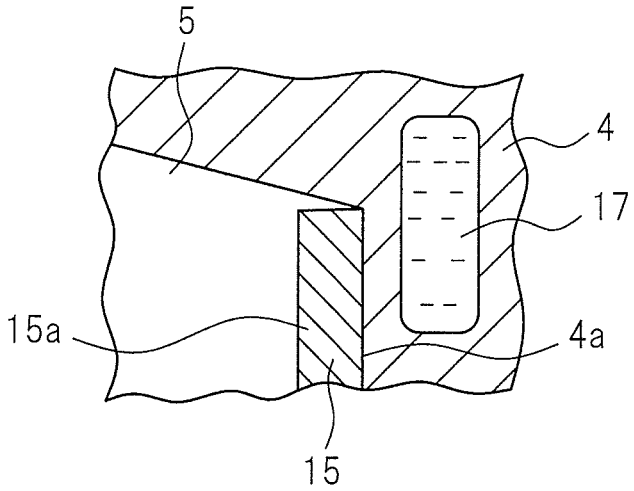
FIG. 9 is an enlarged schematic cross-sectional view of a side of a region in which an end part of a cylinder liner is inserted in a fourth internal combustion engine of the embodiment.

Next, a fourth internal combustion engine of the present embodiment will be explained. FIG. 9 is an enlarged schematic cross-sectional view of a part at the side of a combustion chamber in the fourth internal combustion engine of the present embodiment. In the fourth internal combustion engine, the cylinder head 4 includes a channel for cooling water which is formed at the side of a region in which an end part 15*a* of a cylinder liner 15 is inserted into a recess 4*a*. In the present embodiment, the cooling water jacket 17 is formed as a channel for cooling water. The cooling water jacket 17 is formed near the recess 4*a*. Further, the cooling water jacket 17 is formed at the outside of the cylinder liner 15. The cooling water jacket 17 extends in the direction in which the cylinder liner 15 extends.

In the internal combustion engine in the present embodiment, the heat which is generated in the combustion chamber 5 is transferred through the cylinder liner 15 to the cylinder head 4. For this reason, the wall surface of the combustion chamber 5 easily rises in temperature. In the present embodiment, since the cooling water jacket 17 is formed at the side of the region where the end part 15*a* of the cylinder liner 15 is inserted, the wall surface of the combustion chamber 5 can be effectively cooled.

Further, due to the difference in the coefficient of thermal expansion of the cylinder head 4 and coefficient of thermal expansion of the cylinder liner 15, it is possible to suppress the formation of a space between the cylinder head 4 and the cylinder liner 15. That is, it is possible to secure the seal between the recess 4*a* of the cylinder head 4 and the cylinder liner 15. Further, it is possible to effectively cool the wall surface of the combustion chamber 5 of the cylinder head 4 and possible to suppress the occurrence of knocking and other abnormal combustion.

Furthermore, in the fourth internal combustion engine of the present embodiment, substantially the entirety of each combustion chamber 5 is arranged inside of the cylinder head 4. If running cooling water to the cooling water jacket 17, it is possible to cool the surroundings of the combustion chamber 5. For this reason, it is not necessary to form the cooling water jacket around the holes 2*a* at the cylinder block 2. Since it is possible to eliminate the cooling water jacket around the holes 2*a* of the cylinder block 2, it is possible to simplify the structure of the cylinder block 2.

Figure 10:
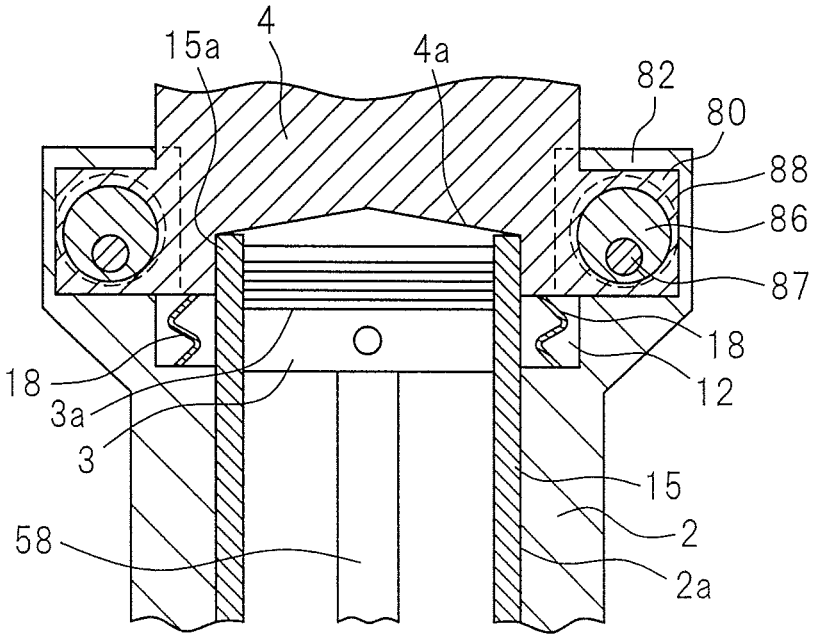
FIG. 10 is a schematic cross-sectional view of a cylinder block and cylinder head in a fifth internal combustion engine of the embodiment.

Next, a fifth internal combustion engine of the present embodiment will be explained. FIG. 10 is a schematic cross-sectional view of the fifth internal combustion engine in the present embodiment. The fifth internal combustion engine in the present embodiment is provided with a sealing member, which is arranged between the cylinder block 2 and the cylinder head 4. In the example which is shown in FIG. 10, as the sealing member, a boot seal 18 is arranged. The boot seal 18 of the present embodiment is arranged at each of the cylinders.

Figure 11:
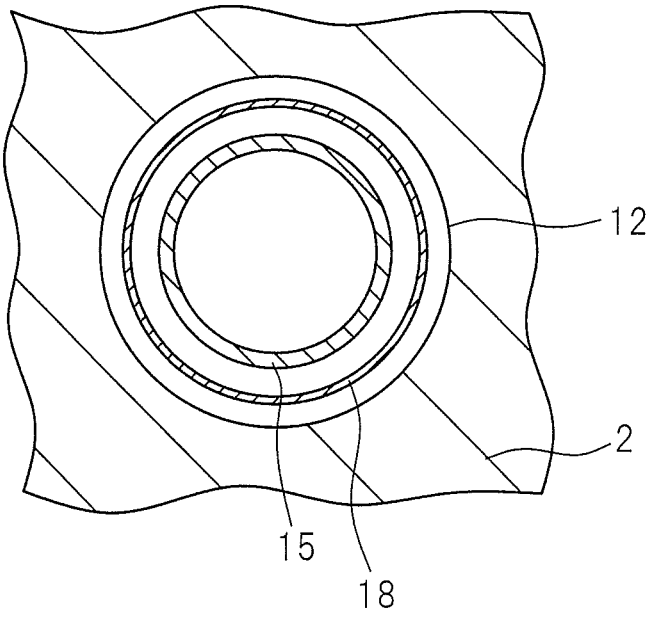
FIG. 11 is a schematic cross-sectional view when cutting along a part at which a sealing member is arranged in the fifth internal combustion engine of the embodiment.

FIG. 11 is a schematic cross-sectional view when cutting along the part where a boot seal 18 is arranged in one cylinder. The boot seal 18 is arranged around a cylinder liner 15. The boot seal 18 has a shape which surrounds the cylinder liner 15. In the present embodiment, the cylinder block 2 is formed with a cutaway part 12. The cutaway part 12 is formed so as to surround the cylinder liner 15. The boot seal 18 is arranged at the inside of the cutaway part 12.

The boot seal 18 is formed to be able to deform along the direction of movement of the piston 3. The boot seal 18 in the present embodiment is formed in an accordion shape. One end part of the boot seal 18 is fastened to the cylinder head 4. The other end part of the boot seal 18 is fastened to the cylinder block 2. The boot seal 18 is formed to be able to expand and contract along with movement of the cylinder head 4 with respect to the cylinder block 2.

In this way, by arranging sealing members between the cylinder block 2 and cylinder head 4, it is possible for the gas which leaks from the sliding parts of the recesses 4*a* of the cylinder head 4 and the cylinder liners 15 to be discharged to the outside.

Even in an internal combustion engine in which the cylinder block moves relative to the crankcase, given as a reference example, a sealing member can be arranged. However, in the internal combustion engine of the reference example, it was necessary to arrange the sealing member so as to surround the cylinder block as a whole. For this reason, the sealing member became large in size. In the internal combustion engine of the present embodiment, it is possible to arrange the sealing member at the outside of the cylindrically shaped cylinder liner, so the sealing member can be made small in size.

The sealing member in the present embodiment is arranged at each of the cylinders, but the invention is not limited to this. It is also possible to have a single sealing member be arranged for a plurality of cylinders. That is, a sealing member may also be arranged so as to surround a plurality of cylinders.

The sealing member in the present embodiment includes an elastic boot seal, but the invention is not limited to this. Any member which can seal the part between the cylinder block and the cylinder head can be arranged. For example, the sealing member may also be a ring-shaped member which fits around the outer circumference of the cylinder liner. Such an axial seal type of sealing member may also be press fit around the outside of the cylinder liner.

The above embodiments can be suitably combined. In the above figures, the same or equivalent parts are assigned the same reference signs. Note that, the above embodiments are illustrations and do not limit the invention. Further, the embodiments include changes within the scope of the claims.

REFERENCE SIGNS LIST

2 cylinder block
2*a* hole
3 piston
4 cylinder head
4*a* recess
5 combustion chamber
12 cutaway part
15 cylinder liner
15*a* end part
15*b* end face
16 coil spring
17 cooling water jacket
18 boot seal
19 space
31 electronic control unit

84, 85 camshaft
86, 88 circular cam
87 eccentric shaft
89 motor

The invention claimed is:

1. An internal combustion engine comprising:

a cylinder block which has a hole inside of which a piston is arranged;

a cylinder head which includes a recess which has a top surface of a combustion chamber;

a cylinder liner which is fastened at a surface of the hole of the cylinder block and which the piston contacts; and a variable compression ratio mechanism which changes a mechanical compression ratio; wherein the variable compression ratio mechanism is formed so that the cylinder head is moved relative to the cylinder block whereby the combustion chamber is variably formed in size, the cylinder liner extends so that, in the range where the cylinder head moves relative to the cylinder block, an end part facing the cylinder head is arranged inside of the recess of the cylinder head, and the end part of the cylinder liner at the side facing the cylinder head becomes gradually thinner toward a front end and has cross-sectional shape which is slanted from the front end toward the inside of the combustion chamber to form tapered shape.

2. The internal combustion engine according to claim 1, wherein the end part of the cylinder liner is formed so as to stick out from the cylinder block and slides with respect to the recess of the cylinder head.

3. The internal combustion engine according to claim 1, further comprising an elastic member which is arranged between the cylinder block and the cylinder head and biases the cylinder head with respect to the cylinder block, wherein the elastic member is arranged around a cylinder liner and has a shape which surrounds the cylinder liner.

4. The internal combustion engine according to claim 1, wherein the cylinder head has a channel for cooling water which is formed at a side of a region in which the end part of the cylinder liner is inserted into the recess.

5. The internal combustion engine according to claim 1, further comprising a sealing member which is arranged between the cylinder block and the cylinder head, wherein the sealing member is arranged around the cylinder liner for each cylinder and has a shape which surrounds the cylinder liner.

* * * * *